US006691782B2

(12) United States Patent
Vandevier

(10) Patent No.: US 6,691,782 B2
(45) Date of Patent: Feb. 17, 2004

(54) METHOD AND SYSTEM FOR BELOW MOTOR WELL FLUID SEPARATION AND CONDITIONING

(75) Inventor: Joseph E. Vandevier, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/058,659

(22) Filed: Jan. 28, 2002

(65) Prior Publication Data

US 2003/0141056 A1 Jul. 31, 2003

(51) Int. Cl.[7] ..... E21B 43/38; E21B 43/24

(52) U.S. Cl. ..... 166/265; 166/302; 166/62; 166/105

(58) Field of Search ..... 166/265, 370, 166/105, 62, 302, 57; 210/512.1, 512.3

(56) References Cited

U.S. PATENT DOCUMENTS

| | | | | |
|---|---|---|---|---|
| 4,537,257 A | | 8/1985 | Todd | |
| 4,749,034 A | | 6/1988 | Vandevier et al. | |
| 4,832,127 A | | 5/1989 | Thomas et al. | |
| 5,159,977 A | * | 11/1992 | Zabaras | 166/105 |
| 5,482,117 A | | 1/1996 | Kolpak et al. | |
| 5,516,360 A | | 5/1996 | Normandeau et al. | |
| 5,525,146 A | | 6/1996 | Straub | |
| 5,554,897 A | | 9/1996 | Martin et al. | |
| 6,033,567 A | * | 3/2000 | Lee et al. | 166/265 |
| 6,056,511 A | | 5/2000 | Kennedy et al. | |
| 6,082,452 A | * | 7/2000 | Shaw et al. | 166/105.5 |
| 6,126,416 A | | 10/2000 | Lee | |
| 6,138,758 A | * | 10/2000 | Shaw et al. | 166/265 |
| 6,189,613 B1 | | 2/2001 | Chachula et al. | |
| 6,190,543 B1 | * | 2/2001 | Christiansen | 210/87 |
| 6,213,736 B1 | | 4/2001 | Weisser | |
| 6,364,013 B1 | * | 4/2002 | Watson et al. | 166/105 |
| 6,382,317 B1 | * | 5/2002 | Cobb | 166/265 |
| 6,457,522 B1 | * | 10/2002 | Bangash et al. | 166/267 |
| 6,494,258 B1 | * | 12/2002 | Weingarten | 166/265 |
| 6,547,003 B1 | * | 4/2003 | Bangash et al. | 166/106 |

* cited by examiner

*Primary Examiner*—David Bagnell
*Assistant Examiner*—Thomas S Bomar
(74) *Attorney, Agent, or Firm*—Bracewell & Patterson, L.L.P.

(57) ABSTRACT

A method and system for downhole treatment and pumping of well fluids enhances the pumping of viscous fluids to the surface. The first step is to separate the oil and water from the well fluid and then channel the oil to a chamber that encloses the motor. The heat from the motor will increase the heat of the crude oil flowing past the motor, thereby lowering the viscosity of the crude oil. The water flows separately past the motor in another passageway, and remixes with the oil. After the oil and water recombine, the treated well fluid has a lower viscosity, and the fluid is then pumped to the surface more efficiently than without treating the oil.

18 Claims, 3 Drawing Sheets

METHOD AND SYSTEM FOR BELOW MOTOR WELL FLUID SEPARATION AND CONDITIONING

BACKGROUND OF THE INVENTION

1. Field of the Invention

The invention relates generally to electrically driven centrifugal submersible well pumps, and in particular to an oil and water separator for separating oil from the well fluid prior to reaching the pump for the purpose of selectively directing oil or water flow into intimate contact with the electric motor.

2. Description of the Related Art

The application of ESPs to viscous crude has been increasing in recent years. Today ESPs are applied to heavy crude production where pumping viscosities can exceed 1000 centipoise. At these viscosities, there are considerable losses associated with ingesting viscous crude within the pump and additional losses experienced in discharge head and efficiency of the pump due to the viscosity. These losses limit the flow rate, therefore limiting the amount of crude produced. These losses also cause severe reduction in the head/stage ratio, thereby requiring a significantly larger pump. Furthermore, the losses cause an increase in the horsepower required to produce the crude, resulting in larger equipment and significant increases in power costs.

A different problem arises in situations where the well fluid entering the well machinery in the well assembly has high temperatures. In this situation, the motor powering the pump experiences temperature problems because the high temperature well fluid passing the motor will not collect the heat from the motor. Therefore, the motor has no way to transfer its heat to the well fluid passing by the motor.

SUMMARY OF THE INVENTION

The system for treating and pumping well fluids of this invention has a downhole motor connected to and below the pump. A shroud encloses a substantial portion of the motor. A separator below the shroud separates the oil and liquid from the well fluid. One of the oil outlets of the separator communicates with the interior of the shroud and the other outlet discharges to the exterior of the shroud. The liquid oil and water recombine before entering the pump.

The shroud prevents the separated oil and water from mixing. In one embodiment, openings in the shroud above the motor allow the water to enter inside the shroud and recombine with the oil before entering the pump. The oil flowing past the motor has a lower thermal conductivity than the water on the exterior of the shroud. The heat generated by the motor lowers the viscosity of the oil.

The separator may be a hydroclone having a conical separation chamber that uses gravity and centrifugal forces to separate the water and oil from the well fluid. Alternatively, the separator may also be a centrifugal separator, having at least one impeller blade and at least one vane, the blades and vanes shearing through the fluid to create centrifugal forces which separate the water from the oil.

Another embodiment is used in the situation where the temperature of the well fluid entering the well prevents the transfer of heat from the motor to the well fluid. In this embodiment, the separator directs the oil to the outside of the shroud and the water to the inside of the shroud. The water from the well fluid is more receptive to receiving the heat from the motor than oil because of a higher thermal conductivity. Therefore, the water in intimate contact with the motor cools the motor while the water flows passes by the motor.

DETAILED DESCRIPTION OF THE PREFERRED EMBODIMENTS

Figure 1B:
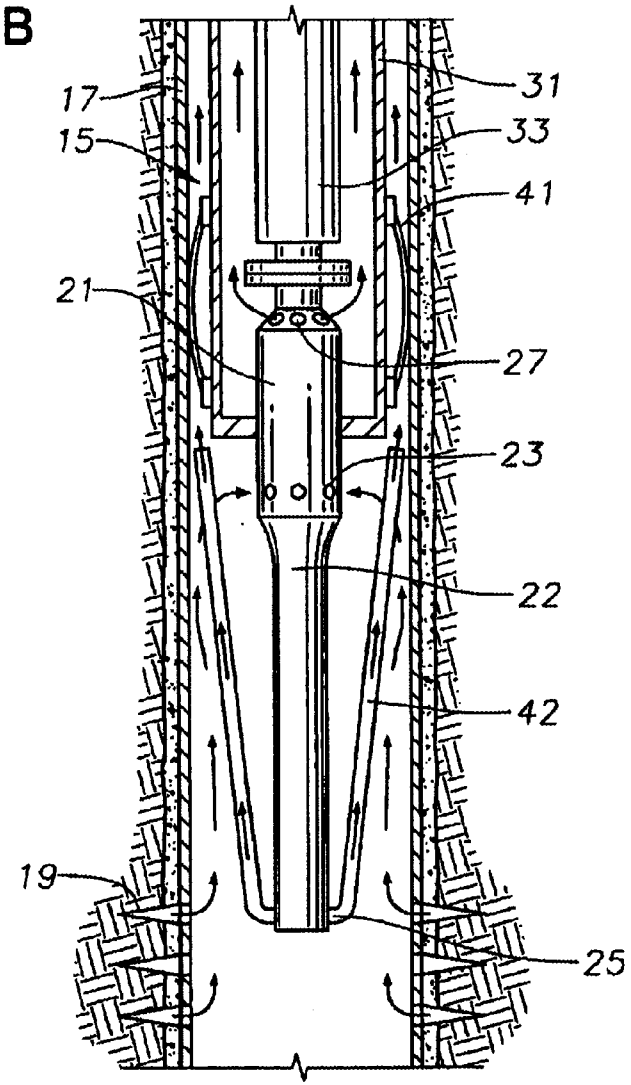
FIGS. 1A and 1B comprise a cross-sectional view of a fluid treatment system constructed in accordance with this invention and in which the separator is a hydrocyclone separator.
Figure 1A:
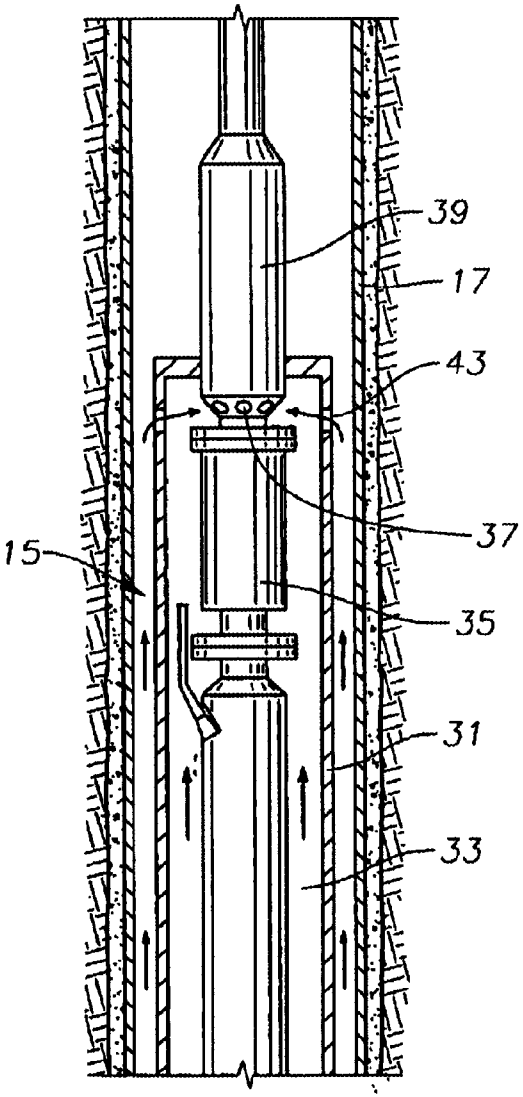

FIGS. 1A and 1B shows a completed well with a downhole fluid treating and pumping system 15 lowered down the casing 17 to above the perforations 19 in the well. The well produces a mixture of viscous oil and water. Generally the viscosity at well formation temperatures will be 500 centipoise or greater. Fluid treating and pumping system 15 has a separator 21 for separating a major portion of the water from the viscous crude. Separator 21 has fluid inlets 23, water outlets 25, and oil outlets 27 at its top.

In the first embodiment, separator 21 is a hydrocyclone separator 21. In this embodiment, inlets 23 are located tangentially around the circumference of the upper portion of separator 21. The hydrocyclone separator 21 has a tapered tube 22 below inlets 23. Liquids enter through tangential inlets 23. This creates a high velocity swirling action and sets up strong centrifugal forces which cause the denser liquid (water) to form at the outer edge, while the less dense liquids (oil and hydrocarbons) migrate to form a core at the center. These centrifugal forces, combined with differential pressures set up across the hydrocyclone, allow the heavier water to exit at the underflow through water outlets 25, while the lighter less dense phase falls into reverse flow and exits at the opposite end as the overflow through oil outlets 27.

A shroud is sealingly connected to separator 21 above water outlets 25 and below oil outlets 27. Shroud 31 circumferentially encloses a motor 33, a seal section 35, and the inlets 37 to a pump 39. Motor 33 powers pump 39, which pumps the well fluids to the surface.

Oil outlets 27 of separator 21 are located within shroud 31 for discharging separated oil into an annular space surrounding motor 33. Conduits 42 lead from water outlet 25 to an annular space surrounding shroud 31. Shroud 31 keeps the water that has been separated from the crude oil in the well fluid from mixing with the oil from the separator while the two fluids travel past motor 33 up the well. Ports 43 are located in the upper end of shroud 31 for causing separated water to enter shroud 31 above motor 33. A centralizer 41 may be positioned on the lower end of shroud 31. Centralizer 41 positions fluid treating and pumping system 15 in the center of the well.

In operation, assembly 15 is lowered down the well on a string of tubing after the well has been completed to a depth just above perforations 19. Oil, gas, and water flow through perforations 19 into the well casing, and flow into separator inlets 23. Separator 21 separates the water and oil and delivers the oil into shroud 31. The oil traverses along the annulus between motor 33 and shroud 31. The oil is heated due to its intimate contact with the motor which reduces its viscosity while at the same time cooling motor 33, keeping it from overheating. The less viscous oil continues to traverse along the annulus inside shroud 31 past seal section 35. As the oil passes seal section 35, water that has been traveling in the annular bypass passage along the outside of shroud 31 enters shroud 31 through shroud inlets 43. The water mixes with the conditioned oil and then the recombined oil and water enter pump 39 through pump inlets 37, to be pumped up to a tree assembly (not shown) on the surface.

Figure 2B:
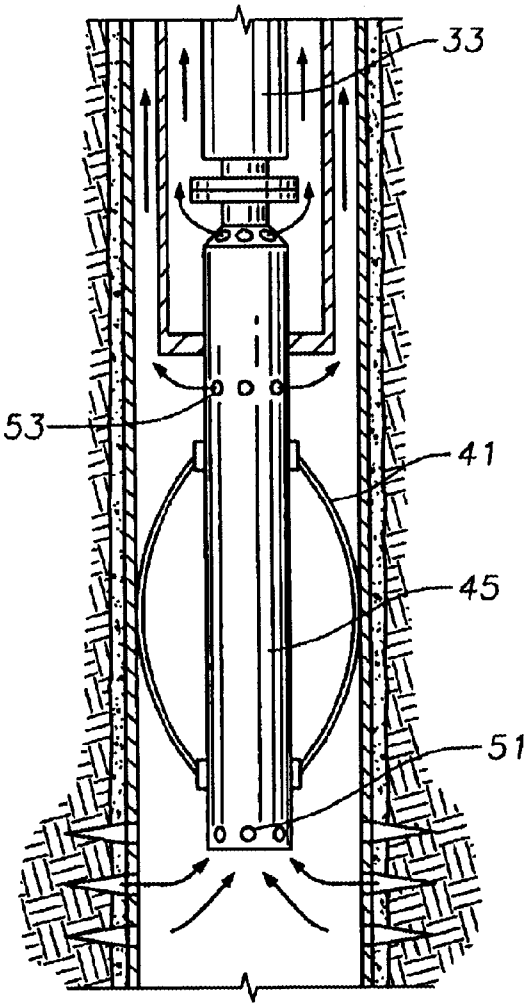
FIGS. 2A and 2B comprise a partial cross-sectional view of an alternative embodiment of a fluid treatment system constructed in accordance with the present invention, in which the separator is a centrifugal separator.
Figure 2A:
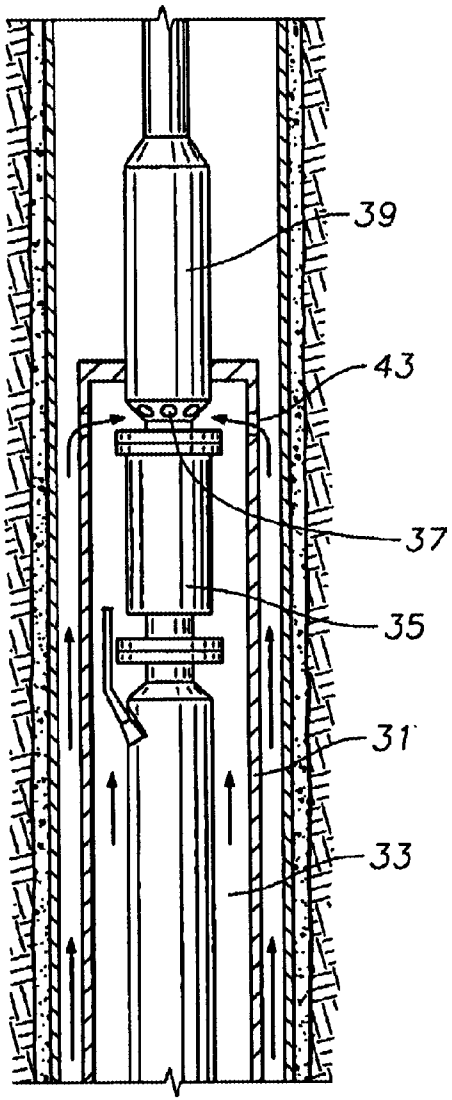
Figure 3:
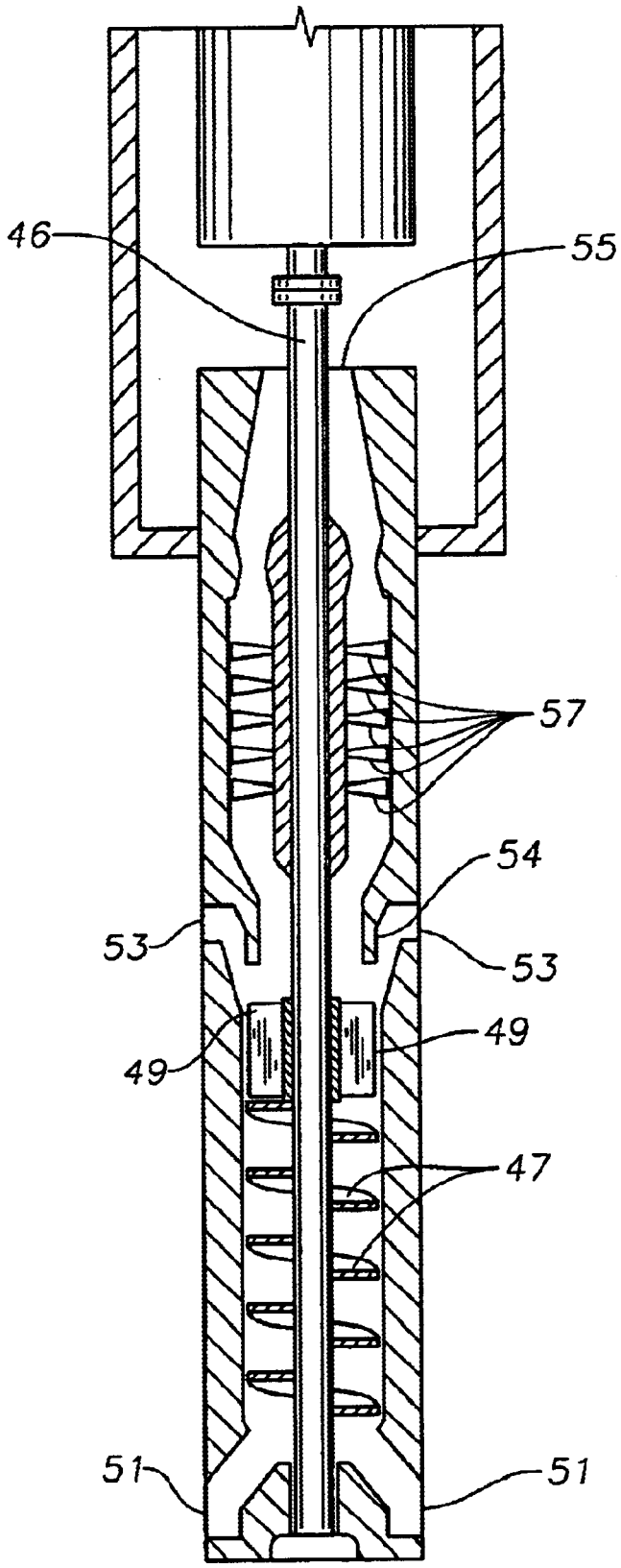
FIG. 3 is a schematic cross sectional view of the separator of FIG. 2B.

FIGS. 2A, 2B and 3 show another embodiment, in which separator 45 is a centrifugal separator having a series of blades 47 and vanes 49 as illustrated schematically in FIG. 3. Motor 33 is connected to and rotates a separator shaft 46, to which blades 47, and vanes 49 are mounted. Separator 45 has well fluid inlet on its lower potion that allow the well fluid to flow into the separator for separation. The rotation of blades 47 applies pressure to the well fluid, causing the well fluid to travel up the separator towards vanes 49. Vanes 49 impart a swirling motion to the well fluid, causing separation between the heavier and lighter liquids. Water, being the heavier liquid, flows to the outer side of lip 54. Oil, being the lighter liquid, flows to the inside of lip 54. The outside of lip 54 leads to water outlets 53. The inside of lip 54 leads to an optional blending region of separator 45 where blades 57 are mounted on separator shaft 21. Blades 57 increase the velocity of the separated oil when they are rotated. Blades 57 discharge the separated oil into a passageway that leads to oil outlets 55, which releases the oil into the annular passage between shroud 31 and motor 33.

The well fluid enters separator 45 through inlets 51, which in this embodiment are located on the lower portion of separator 45. The blades 47 and vanes 49 of separator 45 shear through the viscous crude, thereby creating centrifugal forces on the well fluid as it passes through centrifugal separator 45. The geometry of the path the fluid traverses through the blades 47 and vanes 49 also generates centrifugal forces that are exerted on the fluid as it passes through centrifugal separator 45. The centrifugal forces experienced by the fluids force the heavier water particles to the outer edge of the interior of separator 45 and the lighter crude oil and hydrocarbons to the center of separator 45. The water that has been forced to the far edge of separator 45 will exit separator 45 via water outlets 53 after traversing through the blades and vanes of separator 45. Water outlets 53 in this embodiment are located in the upper portion of separator 45, but below the point in which shroud 31 sealingly connects to separator 45. The lighter oil and hydrocarbons remaining in the center of separator 45 do not exit through water outlets 53, but rather are blended by the high speed rotating blades 57. The high speed rotating blades 57 impart a high rate of fluid shear which can improve the flow properties of fluids like crude oil by increasing the oil's velocity. Increasing the oil's velocity helps to reduce the viscosity of the oil. The blended crude then communicates to separator oil outlets 55 above the point where shroud 31 sealingly connects to separator 45. The blended oil enters the annulus between motor 33 and shroud 31. Once the blended oil enters the annulus inside shroud 31, the oil undergoes the same conditioning process as described above in the first embodiment.

The present invention enhances pumping viscous well fluid by reducing the viscosity of crude oil. The oil heats to a higher temperature when separated than it would if mixed with water. Even when recombined with water, the oil will be less viscous because of its higher temperature. Lowering the viscosity of the fluid being pumped to the surface increases the pump efficiency. A better pump efficiency results in greater flow rates, which leads to increases in oil production. Better efficiency also leads to a reduction in the head to stage ratio, which means for the same amount of fluid delivered to the surface, a smaller pump requiring less horsepower can be used. Lower horsepower requirements means that a smaller motor is needed to drive the pump. All of these results lead to less cost per unit produced.

The embodiment of FIGS. 2A and 2B may be alternately configured so that the water forced to the outer edge of the interior of separator 45 is routed into the annular passage between motor 33 and shroud 31, while the oil exits separator 45 below the point at which shroud 31 sealingly connects to separator 45. The oil traverses along the outside of shroud 31 and then enters shroud 31 through shroud inlets 43. The water traverses along the annulus between motor 33 and shroud 31. The heat from motor 33 is transferred to the water passing by motor 33 in intimate contact with motor 33, therefore cooling motor 33. The water continues to flow up the annular passage inside shroud 31 past seal section 35 and then mixes with the oil entering shroud 31 through shroud inlets 43. The mixed oil and water enter pump 39 through pump inlets 37 to be pumped up to a tree assembly on the surface. Delivering the separated water into shroud 31 could also be done with the embodiment of FIGS. 1A and 1B.

Further, it will also be apparent to those skilled in the art that modifications, changes and substitutions may be made to the invention in the foregoing disclosure. Accordingly, it is appropriate that the appended claims be construed broadly and in the manner consisting with the spirit and scope of the invention herein. For example, the upper end of the shroud could have an opening to discharge oil and be located below the pump inlet. There would be no need for the water to enter the shroud as it would recombine with the oil above the shroud at the pump intake.

What is claimed is:

1. A system for pumping fluids, comprising:

a downhole pump having an intake;

a downhole motor connected to and below the pump;

a shroud that encloses the motor and seals to the pump above the intake of the pump;

a separator that separates oil and water portions from well fluid, having an outlet communicating with the interior of the shroud for flowing one of the portions into the shroud for flowing around the motor, and another outlet discharging to the exterior of the shroud for flowing the other of the portions upward around the exterior of the shroud; and an intake port in the shroud for flowing the other of the portions from the exterior of the shroud into the shroud to recombine the portions prior to entry into the intake of the pump.

2. The system for pumping fluids of claim 1, wherein the outlet communicating with the interior of the shroud is for the oil portion to exit the separator, and the outlet discharging to the exterior of the shroud is for the water portion to exit the separator.

3. The system for pumping fluids of claim 1, wherein the outlet communicating with the interior of the shroud is for the water portion to exit the separator, and the outlet discharging to the exterior of the shroud is for the oil portion to exit the separator.

4. The system for pumping fluids of claim 1, further comprising at least one centralizer for positioning the separator in the center of the well.

5. The system for pumping fluids of claim 1, wherein the separator comprises a hydrocyclone.

6. The system for pumping fluids of claim 1, wherein the separator comprises a centrifugal separator hiving a rotatably driven vane.

7. A system for pumping fluids, comprising:

a downhole pump;

a downhole motor connected to and below the pump;

a shroud that encloses a substantial portion of the motor;

a separator that separates oil and water from well fluid, having an outlet communicating with the interior of the shroud, and another outlet discharging to the exterior of the shroud; and an intake port in an upper portion of the shroud for admitting the water separated from the oil to cause the oil and the water to recombine before entering the pump.

8. A system for pumping fluids, comprising:

a downhole well pump;

a motor that is coupled to and below the pump for driving the pump;

a separator located below the motor for separating water from oil in well fluid, which has at least one inlet for the entry of the well fluid, at least one water outlet for delivering water separated from the well fluid, and at least one oil outlet where the separated oil is discharged;

a shroud that surrounds the motor, an upper portion of the separator, and a lower portion of the pump above an intake of the pump, the shroud having a lower end that is sealingly attached around a circumference of the separator between the water and oil outlets, and has an upper end that is sealingly attached around a circumference of the pump above the inlet of the pump, creating an annulus space inside the shroud that is in fluid communication with the oil outlet, the shroud preventing the separated oil and water from mixing with each other as they travel past the motor; and at least one opening in the shroud above the motor for allowing the water to enter inside the shroud and recombine with the oil before entering the pump.

9. The system for pumping fluids of claim 8 herein the separator is a hydroclone having a conical separation chamber that uses gravity an centrifugal forces to separate the water and oil from the well fluid.

10. The system for pumping fluids of claim 8 wherein:

the opening in the shroud above the motor is above a seal section for the motor and below the pump inlet.

11. The system for pumping fluids of claim 8 wherein:

the separator comprises a centrifugal separator having a rotatably driven vane.

12. The system for pumping fluids of claim 8, wherein the separator comprises a hydrocyclone, and the system further comprises at least one tube routing the separated water to a point above the separator inlet.

13. A method for pumping well fluid, comprising:

(a) providing a downhole pump and motor;

(b) operating the motor in the well;

(c) separating water from crude oil contained in the well fluid; then (d) flowing one of the fluids separated from the well fluid past and in contact with the motor;

(e) flowing the other fluid separated from the well fluid in a bypass passage that passes but does not contact the motor; then (f) recombining above the motor the oil with the water that had been separated out; and (g) directing the recombined oil and water into the pump, which pumps the recombined oil and water to the surface.

14. The method for pumping well fluid of claim 13 wherein oil is the fluid in (d) step flowing past and in contact with the motor, and water is the fluid in step (e) flowing in the bypass passage that passes but does not contact the motor.

15. The method for pumping well fluid of claim 13 where step (c) comprises using a hydrocyclone separator.

16. The method for pumping well fluid of claim 13 wherein step (a) comprises mounting the motor sealingly within a shroud, the bypass passage comprising an annular region surrounding the shroud.

17. The method for pumping well fluid of claim 13 where step (c) comprises using a centrifugal separator that has a rotating vane that is rotated by the motor.

18. A system for pumping fluids, comprising:

a downhole pump having an intake;

a downhole motor connected to and below the pump;

a shroud that encloses a substantial portion of the motor;

a separator that separates oil and water portions from well fluid, having an outlet communicating with the interior of the shroud for flowing one of the portions into the shroud for flowing around the motor, and another outlet discharging to the exterior of the shroud for flowing the other of the portions up around the exterior of the shroud; and means for recombining the portions prior to entering the intake of the pump.

* * * * *

UNITED STATES PATENT AND TRADEMARK OFFICE

CERTIFICATE OF CORRECTION

PATENT NO. : 6,691,782 B2
DATED : February 17, 2004
INVENTOR(S) : Joseph E. Vandevier It is certified that error appears in the above-identified patent and that said Letters Patent is hereby corrected as shown below:

Column 5,
Line 49, after "gravity" the word "an" should be -- and --.

Signed and Sealed this

Fifteenth Day of June, 2004

JON W. DUDAS
*Acting Director of the United States Patent and Trademark Office*